United States Patent [19]

Chen

[11] 4,302,323

[45] Nov. 24, 1981

[54] CATALYTIC HYDROCONVERSION OF RESIDUAL STOCKS

[75] Inventor: Nai Y. Chen, Titusville, N.J.

[73] Assignee: Mobil Oil Corporation, New York, N.Y.

[21] Appl. No.: 148,077

[22] Filed: May 12, 1980

[51] Int. Cl.[3] ..... C10G 45/10; C10G 47/18

[52] U.S. Cl. ..... 208/89; 208/56; 208/108; 208/111

[58] Field of Search ..... 208/111, 56, 57, 89, 208/254 H, 108

[56] References Cited

U.S. PATENT DOCUMENTS

| | | | |
|---|---|---|---|
| 2,727,853 | 12/1955 | Hennig | 208/53 |
| 2,772,214 | 11/1956 | Langer | 208/56 |
| 3,663,429 | 5/1972 | Vallino | 208/108 |
| 3,694,345 | 9/1972 | Bittner | 208/111 |
| 3,775,290 | 11/1973 | Peterson et al. | 208/50 |
| 3,891,538 | 6/1975 | Walkey | 208/50 |
| 3,902,991 | 9/1975 | Christensen et al. | 208/50 X |
| 3,957,622 | 5/1976 | Gatsis | 208/89 |
| 4,090,947 | 5/1978 | Satchell | 208/56 |
| 4,115,246 | 9/1978 | Sweany | 208/56 |
| 4,158,676 | 6/1979 | Smith et al. | 585/481 |

*Primary Examiner*—Delbert E. Gantz
*Assistant Examiner*—G. E. Schmitkons
*Attorney, Agent, or Firm*—Charles A. Huggett; Michael G. Gilman; Charles J. Speciale

[57] ABSTRACT

Hydrotreating and hydrocracking of heavy residual stocks are improved with respect to conversion, product distribution, product quality and system operability by mixing with the heavy charge a substantial proportion of an aromatic light distillate oil (light gas oil) of high nitrogen content.

15 Claims, 2 Drawing Figures

CATALYTIC HYDROCONVERSION OF RESIDUAL STOCKS

BACKGROUND OF THE INVENTION

1. Field of the Invention

This invention is concerned with conversion of the heavy end of crude petroleum and like source materials predominating in hydrocarbons and hydrocarbon derivatives such as tars (e.g. from tar sands) and the like. The conversion products are useful as fuels and as charge stocks for other conversion processes such as catalytic cracking, reforming etc.

With increasing demand for premium fuels such as motor gasoline, diesel fuel, jet fuel and furnace oils, the industry has increasingly been pressed to utilize poorer grade crude oils and to use greater proportion of the available crudes in manufacture of premium products. Many of the crudes contain metal compounds, sulfur compounds, nitrogen compounds and the highly condensed hydrocarbons sometimes called asphaltenes which lead to carbonaceous deposits in processing equipment and/or fuel nozzles and the like. These undesirable components are generally found in the higher boiling components of a crude petroleum and therefore tend to be concentrated during distillation of the crude into the higher boiling fractions, particularly the bottoms fractions of crude stills. Those bottoms are the unvaporized liquids, remaining after vaporization at atmospheric pressure or under vacuum. These are generally called "residual stocks" or simply "resids". This invention is concerned with catalytic conversion under hydrogen pressure to upgrade and convert the atmospheric and vacuum resids taken as bottoms from atmospheric and vacuum crude stills.

2. The Prior Art

A great many expedients have been proposed for dealing with the problems which arise in use of resids as fuels or as charge to such processes as catalytic cracking. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780° to 840° F. During the long residence time at this temperature, the charge is converted to coke and distillate products taken off the top of the drum for recovery of "coker gasoline", "coker gas oil" and gas. The other coking process now in use employs a fluidized bed of coke in the form of small gradules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge.

These coking processes are known to induce extensive cracking of components which would be valuable for catalytic cracking charge, resulting in gasoline of lower octane number (from thermal cracking) than would be obtained by catalytic cracking of the same components. The gas oils produced are olefinic, containing significant amounts of diolefins which are prone to degradation to coke in furnace burners and on cracking catalysts. It is often desirable to treat the gas oils by expensive hydrogenation techniques before charging to catalytic cracking. Coking does reduce metals and Conradson Carbon but still leaves an inferior gas oil for charge to catalytic cracking.

Catalytic charge stock and fuels may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked naphtha. Low temperature, liquid phase sorption on catalytically inert silica gel is proposed by Shuman and Brace, OIL AND GAS JOURNAL, Apr. 16, 1953, Page 113.

Catalytic hydrotreating alone or in combination with hydrocracking is a recognized technique for improving resids. Contact of the resid with suitable catalysts at elevated temperature and under high hydrogen pressure results in reduction of sulfur, nitrogen, metals and Conradson Carbon (CC) content of the charge stock. Hydrotreating in the term applied here to operations over a catalyst of a hydrogenation metal on a support of low or negligible cracking activity. Metals, particularly nickel and vanadium are thereby split out of the complex molecules in which they occur and are deposited on the hydrotreating catalyst. Sulfur and nitrogren are converted to hydrogen sulfide and ammonia in hydrotreating and separated with a gas phase after condensation of the liquid hydrocarbons resulting from the treatment.

The hydrocracking catalysts are characterized by dual functions of a hydrogenation/dehydrogenation metal function associated with an acid cracking catalyst which may also serve as support for the metal, e.g., hydrogen form of ZSM-5. The hydrocracking operation removes sulfur, nitrogen and metals from the charge and also converts polycyclic compounds, including asphaltenes, by ring opening and hydrogenation.

In addition to its use in feed preparation, hydrotreating has also been applied in "finishing" of refinery products by desulfurization, saturation of olefins and the like. It has been proposed to combine the feed preparation and product finishing functions by blending intermediate gasoline, gas oils and like fuels with fresh crude. Suitable process flow diagrams for that purpose are described in U.S. Pat. No. 3,775,290 to Peterson et al. and U.S. Pat. No. 3,891,538 to Walkey. The latter at column 5, discusses the benefits of so recycling catalytic cycle oil boiling to 800° F. and coker gas oil boiling to 900° F. In addition, it may be speculated that the diluent effect of the recycled gas oils and the hydrogen donor capabilities of polycyclic compounds therein can be expected to improve hydrotreating of feed stocks which contain asphaltenes.

Nitrogen compounds are generally recognized as detrimental to the activity of acid catalysts such as those employed for cracking and hydrocracking. That principle is discussed in U.S. Pat. No. 3,694,345 in describing a hydrocracking catalyst which is effective in the presence or absence of nitrogen compounds. The process of U.S. Pat. No. 3,657,110 takes advantage of the deactivating effect on nitrogen compounds by introduction of high nitrogen feed along the length of a hydrocracker to moderate the exothermic reaction and aid in control of temperature.

SUMMARY OF THE INVENTION

It has now been demonstrated that a cascade hydrotreater/hydrocracker facility for upgrading residual stocks is improved by adding to the resid charge a portion of light catalytic cycle oil containing a substantial quantity of nitrogen compounds. The light cycle oil (hereafter LCO) is the fraction from distillation of catalytic cracker product which boils in the range of 420° F. to 700° F. The initial boiling point may vary considerably within the range stated depending on operation of the catalytic cracker main column. Some variation in the end boiling point is also contemplated, but the "cut point" in the fractionator should not be substantially above 700° F.

The proportion of light catalytic cycle oil will vary with nitrogen content, character to the resid and results desired but generally will be an amount between about 10% and 200% of resid charge, i.e., a weight ratio of cycle oil to resid between about 0.1 and 2.

No explanation is now offered on the reason the LCO must contain nitrogen in amounts of at least 0.1 weight percent. That reason is not now understood. Generally the nitrogen content will be below 1.0 weight percent. Experiments reported below demonstrate that nitrogen in the LCO produces advantageous results. Runs were made with tetralin added to the resid to test whether the effect observed with LCO were due to the diluent effect of an aromatic liquid and/or the presence of hydrogen donor compounds. The results with tetralin are clearly inferior to those achieved with the nitrogen contaminated LCO. It is concluded that nitrogen is of significant importance.

DESCRIPTION OF THE DRAWINGS

An exemplary refinery flow diagram for application of the invention is presented in FIG. 1

The bar charts of FIG. 2 are a graphical representation of advantages realized from practice of the invention based on experimental runs described hereinafter.

DESCRIPTION OF SPECIFIC EMBODIMENTS

The process of the invention is characterized by a cascade hydrotreater/hydrocracker combination in which resid charge mixed with nitrogenous LCO and hydrogen is passed over a hydrotreating catalyst at hydrotreating conditions of temperature, pressure and hydrogen supply. The hydrotreater effluent is passed directly (cascaded) to a hydrocracking catalyst reactor operated at hydrocracking conditions. It is preferred that the hydrocracking catalyst contain a zeolite cracking component associated with a metal hydrogenation component. That zeolite component of the hydrocracking catalyst is advantageously a zeolite such as zeolite ZSM-5 characterized by a silica/alumina ratio greater than 12 and a constrain index of 1–12. Constraint indices have been previously described for example in U.S. Pat. No. 4,158,676. The definition of a class of zeolites in columns 3–8 of that patent are incorporated herein by this reference.

The cascade hydrotreater/hydrocracker is operated at conditions generally recognized in the art, say 650°–900° F., pressure of about 200 to 3000 psig and space velocities in the range 0.1 to 4 volumes of liquid hydrocarbon per volume of each catalyst per hour. Hydrogen will be supplied at a rate of 500 to 20,000 SCF/barrel of charge. Operation according to this invention is preferably at relatively lower pressure, below about 1500 psig, often in the neighborhood of 1000 psig. Such low pressure hydrocracking is sometimes hereinafter designated "LPHC".

The hydrotreating catalyst is of the type generally known for such operations, conventionally an element from Group VI of the Periodic Table together with a metal from Group VIII on a refractory support such as alumina.

Advantageously, the process of the invention can be carried out in a downflow cascade hydrotreating/hydrocracking reactor in which the charge of petroleum resid and nitrogen-containing catalytic cycle oil flow downwardly in trickle fashion over the successive catalysts. Hydrogen flow is preferably concurrent with the charge downward through the reactor. The addition of catalytic cycle oil prevents aggregation of asphaltene molecules and facilitates their conversion. A significant benefit of the invention is that production of gaseous products of four or less carbon atoms is reduced. The cycle oil addition also improves the efficiency of demetalation, Conradson Carbon removal and desulfurization in the hydrotreating zone, but not denitrogenation. These results were not observed when tetralin was the added solvent employed in the same manner.

Figure 1:
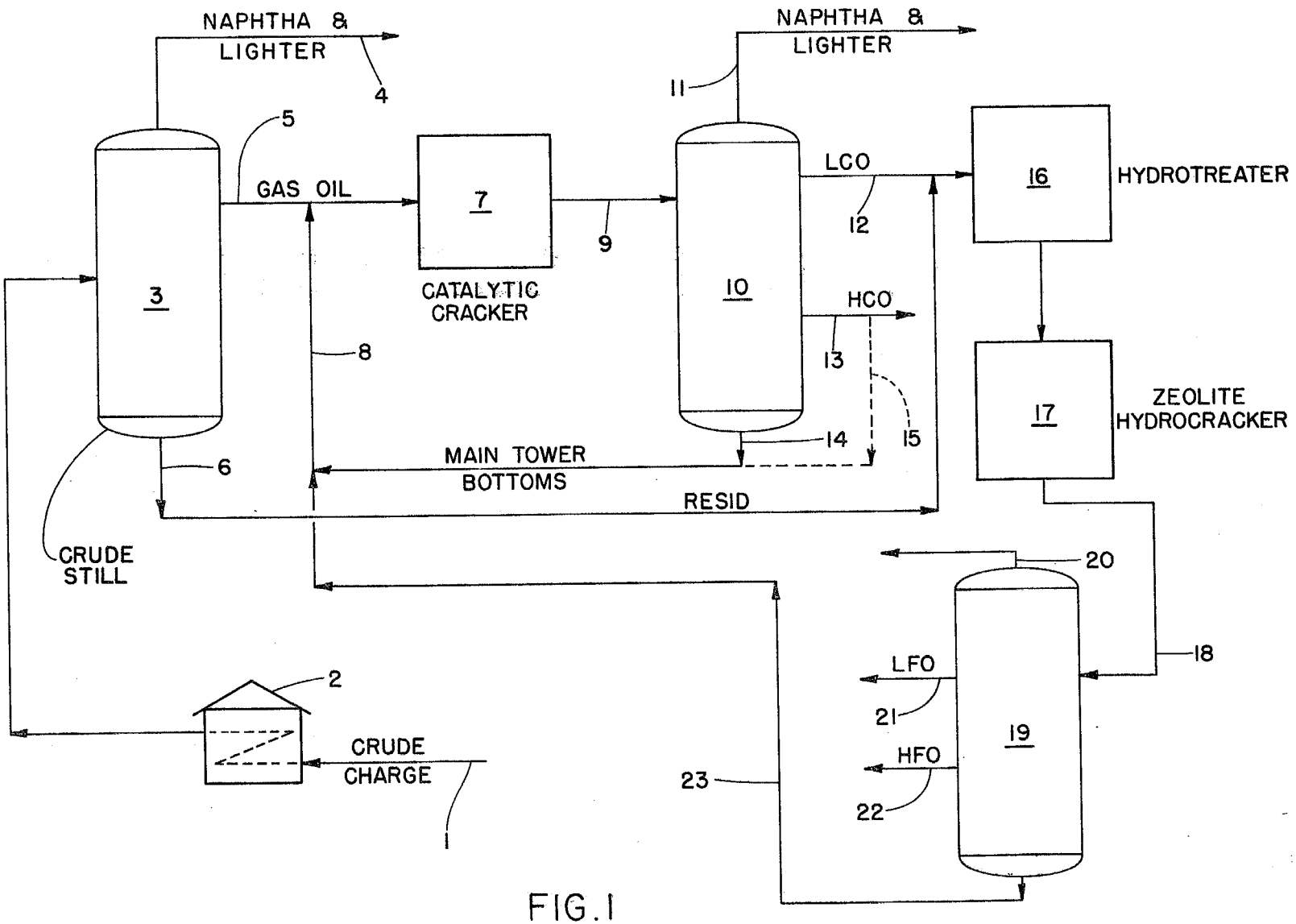

The process of the invention is advantageously carried out in refinery facilities in the nature of that shown diagrammatically in FIG. 1. A nitrogen-containing crude petroleum charge is supplied by line 1 to a suitable furnace 2 where it is heated to a temperature for fractional distillation in crude still 3. The crude still may be a single column operating at atmospheric pressure or may include a vacuum tower for further distillation of atmospheric tower bottoms. As shown in the drawing, the fractions from the crude still are constituted by three streams of naphtha and lighter at line 4, gas oil at line 5 and a resid fraction at line 6. As well known in the art, crude stills may be operated to produce a variety of cuts including kerosene, jet fuels, light and heavy atmospheric gas oils, light and heavy vacuum gas oils, etc.

In the simplied embodiment shown, the single gas oil stream at line 5 is transferred to catalytic cracking facility 7 which may be of any desired type but is preferably Fluid Catalytic Cracking (FCC) of the riser type. Desired recycle streams are added to the charge for cracker 7 by line 3. The effluent of the cracker 7 passes by line 9 to main tower fractionator 10 from which desired products are withdrawn. Naptha and lighter may be taken overhead at line 11 as a fraction boiling up to about 420° F. A light cycle oil, boiling up to about 700° F. is withdrawn by line 12. It will be understood that the light cycle oil (LCO) in line 12 may have an initial boiling point above 400° F. by reason of operating tower 10 to take kerosene and/or jet fuel as side streams. Regardless of initial boiling point, the LCO will result from a distillation cut point not substantially above about 700° F. Also produced by main tower 10 is a heavy cycle oil (HCO) taken off by line 13 for fuel and a bottoms fraction at line 14 which may be recycled to line 8 as recycle charge for cracker 7. Alternatively, all or a portion of the heavy cycle oil may be so recycled as indicated by broken line 15.

The nitrogen-containing LCO in line 12 (derived by catalytic cracking of the gas oil fraction of the crude) is blended with the resid fraction from line 6 to provide charge to hydrotreater 16, operated in the manner described above. Effluent of hydrotreater 16 is transferred without separation to hydrocracker 17, the operation of which also has been described above. Although hydrotreater 16 and hydrocracker 17 are shown as separate stages, there are not necessarily in separate vessels. The two are advantageously separate beds of catalyst in the same downflow reaction vessel.

The product of hydrotreating/hydrocracking is transferred by line 18 to fractionator 19 from which light products are taken overhead by line 20. Light fuel oil and heavy fuel oil are taken as side streams from fractionator 19 by line 21 and 22, respectively. Bottoms from fractionator 19 provide suitable catalytic cracking charge and are recycled for that purpose by line 23. Depending on the desired product slate, the streams at lines 21 and 22 may be recycled in whole or part to catalytic cracker 7. The bottoms from fractionator 19 are suited to use as residual fuel stock and may be withdrawn for that purpose.

Figure 2:
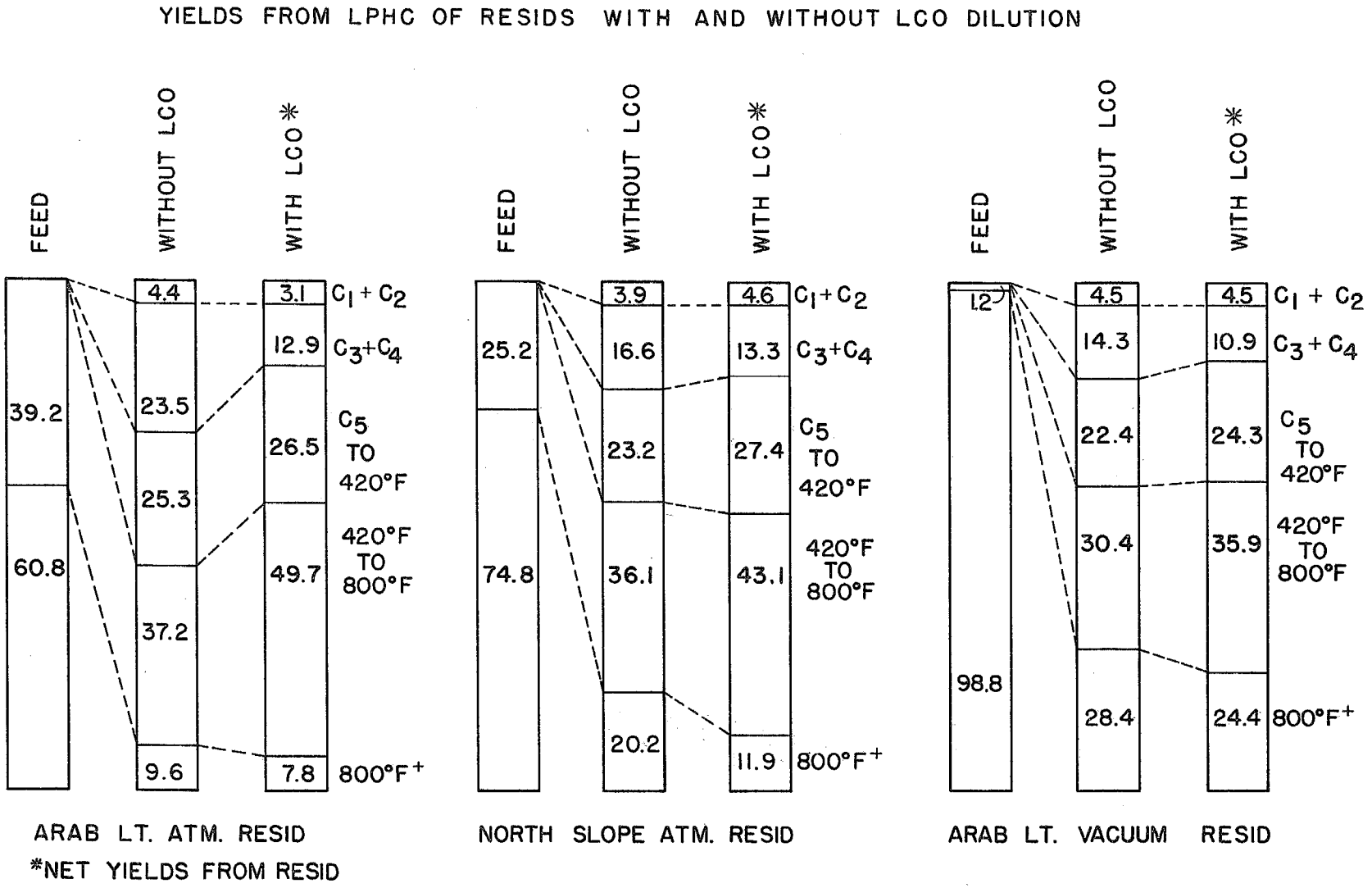

The bar charts of FIG. 2 make a graphic showing of the experimental data presently to be described. The charts of FIG. 2 represent a comparison of various fractions in certain residual feed stocks with yields of like fractions in products of hydrotreating/hydrocracking with and without added nitrogen containing light cycle oil derived by FCC cracking. The yields on processing with LCO are net yields from the resid calculated by subtraction from the observed yields of values determined by like processing of the LCO alone.

It will be observed from FIG. 2 that, for each of the resids tested, the yield of the premium products (distillate fuels) is dramatically increased. Those premium products include motor gasoline in the range of $C_5$ to 420° F. and distillate fuel oils in the range of 420° F. to 800° F.

The bar charts are based on study of solvent dilution in the low pressure hydrotreating/hydrocracking of resids in a downflow cascade reactor at 1100 psig. Included in this study were the following three residual stocks:

1. Arab Light Atmospheric Resid
2. Arab Light Vacuum Resid
3. North Slope Atmospheric Resid The addition of a FCC light cycle oil to the resids effects a significant shift in product distribution with a net increase in distillate yields at the expense of $C_4^-$'s. The following shows a comparison of the yield with or without FCC light cycle oil for Arab Light Atmospheric Resid:

| | Feed | Resid Only | Net Yield With Solvent | Δ |
|---|---|---|---|---|
| $C_1$ | | 1.8 | 1.6 | (.2) |
| $C_2$ | | 2.6 | 1.6 | (1.00) |
| $C_3$ | | 10.6 | 5.6 | (5.00) |
| $C_4$ | | 12.9 | 7.4 | (5.50) |
| $C_5$–420° F. Naphtha | | 25.3 | 26.5 | 1.2 |
| 420–650° F. LFO | 15.9 | 23.1 | 31.9 | 8.8 |
| 650–800° F. HFO | 23.5 | 14.1 | 17.6 | 4.4 |
| 800–1000° F. | 25.8 | 5.5 | 5.1 | (0.4) |
| 1000° F.+ | 34.8 | 4.1 | 2.7 | (1.4) |

Similar results were obtained on all three resids studied.

The addition of a FCC cycle oil also increased significantly the efficiency of demetalation, Conradson Carbon (CCR) removal, and desulfurization but not denitrogenation.

These effects were not observed when tetralin was the added solvent.

Solvent dilution greatly facilitates the handling and processing of residual feedstocks, particularly the vacuum resid, allowing the process to be carried out at lower pressures, higher temperatures and higher space velocities than otherwise feasible.

These findings improve the attractiveness of low pressure hydrocracking as a process to maximize distillate yield from resids and other petroliferous feedstocks. They suggest that solvent dilution could have beneficial effects in hydrotreating residual feedstocks for catalytic cracking.

The experiments reported below compare hydrotreating/hydrocracking (hereafter HT/HC) of the three typical resids with and without the two solvents and with HT/HC of the solvents alone. One solvent employed was light FCC cycle oil produced at the Torrance, California refinery of Mobil Oil Corporation. The other solvent considered was tetralin. Inspection data on the resids and on Torrance FCC light cycle oil are reported in Table 1.

TABLE 1

| | Feedstock Properties | | | |
|---|---|---|---|---|
| | Arab Light Atm. Resid | North Slope Atm. Resid | Arab Light Vacuum Resid | Torrance FCC LCO |
| Boiling Point distribution, wt % | | | | |
| 420° F.− | — | — | — | 4.8 |
| 420–650° F. | 15.9 | 1.2 | — | 87.9 |
| 650–800° F. | 23.5 | 24.0 | 1.2 | 7.3 |
| 800–1000° F. | 25.8 | 25.8 | 38.1 | — |
| 1000° F.+ | 34.8 | 49.0 | 60.7 | — |
| H, wt % | 12.00 | 11.36 | 10.60 | 10.64 |
| S, wt % | 2.50 | 1.60 | 4.13 | 1.01 |
| N, wt % | 0.12 | 0.36 | 0.32 | 0.24 |
| Ni + V, PPM | 23.1 | 52.0 | 83.0 | — |
| CCR, wt % | 5.48 | 8.06 | 17.47 | — |
| Paraffins wt % | 24.7 | 9.5 | — | 12.7 |
| Mononaphthenes | 7.8 | 7.3 | — | 11.7 |
| Polynaphthenes | 12.9 | 15.9 | — | 12.8 |
| Monoaromatics | 23.5 | 27.1 | — | 24.7 |
| Diaromatics | 14.7 | 19.7 | — | 21.7 |
| Polyaromatics | 9.1 | 17.6 | — | 14.3 |
| Aromatic sulfur type | 7.3 | 2.9 | — | 2.1 |

The HT/HC runs were all conducted at the same conditions in a bench scale reactor with the same catalysts. The hydrocracking (HC) catalyst was zeolite ZSM-5 of 48 silica/alumina ratio containing 1.9 weight percent palladium and 1.5 weight percent zinc, without binder. The hydrotreating catalyst was cobalt-molybdenum on a titania/zirconia support containing 5.5 weight percent cobalt as CoO and 9.8 weight percent molybdenum as $MoO_3$. These catalyst were loaded into a tubular downflow reactor with a first (top) layer of HT catalyst, intermediate layers of mixed HT/HC catalyst and a final (bottom) layer of HC catalyst. The conditions in all runs were:

| | |
|---|---|
| Temperature: | Hydrotreating 825° F. |
| | Hydrocracking 875° F. |
| LHSV: | Hydrotreating 2 V/V/hr |
| | Hydrocracking 2 V/V/hr |
| Pressure: | 1100 psig |
| $H_2$/oil ratio: | 2,000 SCF/BBL |

EXAMPLES 1-3

Hydrocracking of resids without added solvent

The detailed material balances for HT/HC of the three resids are given in Table 2 and represented graphically in FIG. 2. The data show that with increasing boiling point of the feedstock, the 420° F.− yield decreased without a significant loss of $C_5$+ gasoline yield. In other words, the heaviest feedstock (Arab Light Vacuum Resid) gave the highest gasoline selectivity ($C_5$-420° F./420° F.−) and the lightest feedstock (Arab Light Atmospheric Resid) gave the highest LPG selectivity ($C_3+C_4$/420° F.−). A comparison of these three feedstocks is summarized as follows:

| | Arab Light Atmospheric | North Slope Atmospheric | Arab Light Vacuum |
|---|---|---|---|
| Boiling range | 420° F.+ | 650° F.+ | 800° F.+ |
| 1000° F.+ in feed wt % | 34.8 | 49.0 | 60.7 |
| 420° F.− yield | 52.1 | 43.7 | 41.2 |
| LPG selectivity | 45 | 38 | 35 |
| $C_5$-420° F. selectivity | 47 | 53 | 55 |
| RON + O | 72.8 | 69.5 | 60.0 |

TABLE 2

LPHC of Resids

Pressure: 1100 psig
Temperature: 825° F./875° F. (HT/HC)
LHSV: 2/2 V/V/hr (HT/HC)
$H_2$/Oil: 2,000 SCF/BBL

| | Arab Lt. Atm. Resid | | North Slope Atm. Resid | | Arab Lt. Vacuum Resid | |
|---|---|---|---|---|---|---|
| Example No. | Feed | 1 | Feed | 2 | Feed | 3 |
| Yield Distribution, wt % | | | | | | |
| $C_1$ | | 1.8 | | 1.8 | | 2.2 |
| $C_2$ | | 2.6 | | 2.1 | | 2.3 |
| $C_3$ | | 10.6 | | 7.2 | | 6.3 |
| $C_4$ | | 12.9 | | 9.4 | | 8.0 |
| $C_5$-420° F. | | 25.3 | | 23.2 | | 22.4 |
| 420-650° F. | 15.9 | 23.1 | 1.2 | 20.6 | | 18.3 |
| 650-800° F. | 23.5 | 14.1 | 24.0 | 15.5 | 1.2 | 12.1 |
| 800-1000° F. | 25.8 | 5.5 | 25.8 | 11.2 | 38.1 | 11.4 |
| 1000° F.+ | 34.8 | 4.1 | 49.0 | 9.0 | 60.7 | 17.0 |
| Conversions, wt % | | | | | | |
| 420° F.− | | 52.1 | | 43.7 | | 41.2 |
| 650° F.− | | — | | 64.3 | | 59.5 |
| 800° F.− | | — | | — | | 71.6 |
| Selectivities, (420° F.−) | | | | | | |
| $C_1 + C_2$ | | 8 | | 9 | | 11 |
| $C_3 + C_4$ | | 45 | | 38 | | 35 |
| $C_5$-420° F. | | 47 | | 53 | | 55 |
| $C_6$+ Liquid Properties | | | | | | |
| H, wt % | 12.00 | 11.30 | 11.36 | 10.78 | 10.60 | 10.22 |
| S, wt % | 2.50 | 1.46 | 1.60 | 1.19 | 4.13 | 2.80 |
| N, wt % | 0.12 | 0.12 | 0.36 | 0.41 | 0.32 | 0.34 |
| Ni + V, PPM | 23.1 | 2.3 | 52.0 | 8.9 | 83.0 | 12.1 |
| CCR, wt % | 5.48 | 3.17 | 8.06 | 5.32 | 17.47 | 12.45 |
| $H_2$ Consumption, SCF/BBL | | 940 | | 840 | | 960 |
| Total S removal, wt % | | 62 | | 45 | | 49 |
| Total N removal, wt % | | 35 | | 17 | | 20 |
| Total Ni + V removal, wt % | | 93 | | 87 | | 89 |
| Total CCR removal, wt % | | 52 | | 34 | | 46 |
| Material Balance, wt % | | 100.0 | | 101.7 | | 94.0 |

Comparison of the LPHC yields between an Arab Light Atmospheric Resid and an Arab Light heavy vacuum gas oil shows that the low pressure hydrocracking process is insensitive to the boiling range of the feedstock. The only variable attributable to the difference among these feedstocks observed in the present study, is the nitrogn content of the feedstocks. Lower conversion and higher gasoline selectivity appear to be associated with high nitrogen feedstocks.

EXAMPLE 4 & 5

Hydrocracking of Solvents

The detailed material balances for the FCC light cycle oil and tetralin are given in Table 3.

The Torrance FCC light cycle oil, which contained a high concentration of dicyclic aromatics, nitrogen and sulfur compounds was quite refractory. At the chosen reaction condition, the 420° F.− yield was 24.5 wt % with a gasoline selectivity ($C_5$-420° F. yield/420° F.− yield) of 69. These results were used in calculating the net yields from hydrocracking resid/light cycle oil mixture.

Under the chosen reaction condition, tetralin undergoes isomerization, ring opening, dealkylation, alkylation and disproportionation reactions to yield products boiling both above and below tetralin. They have not been individually identified. The $C_5$-400° F. fraction consists of mainly BTX with a ratio of 2:1:1 (benzene:toluene:xylene). The high benzene yield was not observed with other feedstocks.

TABLE 3

LPHC of Torrance FCC Light Cycle Oil and Tetralin

Pressure: 1100 psig
Temperature: 825° F./875° F. (HT/HC)
LHSV: 2/2 V/V/hr (HT/HC)
$H_2$/oil: 2,000, SCF/BBC

| | Torrance FCC | Torrance LCO | Tetralin | | | |
|---|---|---|---|---|---|---|
| Example No. | Feed | 4 | Feed | 5 | | |
| Yield Distribution, wt % | | | | | | |
| $C_1$ | | 1.4 | | 0.4 | | |
| $C_2$ | | 1.3 | | 1.1 | $C_5$ | 1.2 |
| $C_3$ | | 2.3 | | 5.0 | Benzene | 14.4 |
| $C_4$ | | 2.6 | | 3.0 | Toluene | 7.3 |
| $C_5$-400° F. | 4.8 | 16.9 | 100 | 41.2 | $A_8$ | 5.8 |
| 400-420° F. | | | | 20.1 | $A_9$+ | 12.5 |
| 420-450° F. | 87.9 | 71.8 | | 21.8 | | |
| 450-650° F. | | | | 7.0 | | |
| 650° F.+ | 7.3 | 3.8 | | 0.4 | | |
| Conversion | | | | | | |
| 400° F.− | | — | | 50.7 | | |
| 420° F.− | | 24.5 | | — | | |
| $C_5$-400° F./400° F.− | | — | | 81 | | |
| $C_5$-420° F./420° F.− | | 69 | | — | | |
| $C_6$+ liquid properties | | | | | | |
| H, wt % | 10.64 | 11.01 | | na | | |
| S, wt % | 1.01 | 0.10 | | — | | |
| N, wt % | 0.24 | 0.06 | | — | | |
| $H_2$ Consumption, SCF/BBL | | 690 | | na | | |

EXAMPLE 6

Hydrocracking of Arab Light Atmospheric Resid diluted with LCO.

The Arab Light Atmospheric Resid was mixed with Torrance FCC light cycle oil in a 2:1 (resid/LCO) weight ratio.

The net yield for the resid was calculated from the raw data and the data for the FCC light cycle oil by assuming that the conversion of the light cycle oil was unaffected by the resid. The detailed material balances and the calculated results are given in Table 4. Also shown in Table 4 are the data for the resid run alone. From Table 4, the advantages of diluting the atmospheric resid with the Torrance FCC light cycle oil may be summarized as follows:

1. The LPG ($C_3+C_4$) yield was reduced from 23.5 wt % to 12.9 wt %.
2. The 800° F.+ product was reduced from 9.6 wt % to 6.8 wt %.
3. The distillate yield ($C_5$-800° F.) was increased from 62.5 wt % to 76.0 wt %.
4. The efficiency of demetalation was increased from 93 percent to 99 percent.
5. The efficiency of Conradson Carbon (CCR) removal was increased from 52 percent to 85 percent.
6. The rate of desulfurization was increased from 60 percent to 67 percent.
7. The net rate of denitrogenation was lower probably due to the high nitrogen content of the cycle oil.

The improvement in the conversion of high molecular weight components in the resid may be attributed to the solvation power of the diluent which breaks up the asphaltenic and resinous aggregates to smaller molecules.

However, the cause of the observed change in LPG/distillate ratio has not been clearly understood. It is speculated that the nitrogen compounds in the cycle oil may play an important role in reducing excessive secondary cracking by moderating the acid sites of the ZSM-5 catalyst. It is also possible that the dicyclic aromatics of the cycle oil may react with $C_4$− cracked fragments to form alkylated products boiling in the distillate range.

TABLE 4

LPHC of Arab Lt. Atm. Resid Diluted with Torrance FCC Light Cycle Oil

Pressure: 1100 psig
Temperature: 825° F./875° F. (HT/HC)
LHSV: 2/2 V/V/hr (HT/HC)
$H_2$/oil: 2,000 SCF/BBL
Resid/LCO wt. ratio = 2/1

| | Raw Data | | Calculated net yield | | Without | |
|---|---|---|---|---|---|---|
| Example No. 6 | Feed | | Feed | | LCO | Δ |
| Yield Distribution, wt % | | | | | | |
| $C_1$ | | 1.5 | | 1.6 | 1.8 | (.2) |
| $C_2$ | | 1.5 | | 1.6 | 1.6 | (1.0) |
| $C_3$ | | 4.5 | | 5.6 | 10.6 | (5.0) |
| $C_4$ | | 5.8 | | 7.4 | 12.9 | (5.5) |
| $C_5$-420° F. | 1.6 | 23.3 | | 26.5 | 25.3 | 1.2 |
| 420-650° F. | 40.6 | 45.2 | 15.9 | 31.9 | 23.1 | 8.8 |

TABLE 4-continued

LPHC of Arab Lt. Atm. Resid Diluted with Torrance FCC Light Cycle Oil

Pressure: 1100 psig
Temperature: 825° F./875° F. (HT/HC)
LHSV: 2/2 V/V/hr (HT/HC)
$H_2$/oil: 2,000 SCF/BBL
Resid/LCO wt. ratio = 2/1

| | Raw Data | | Calculated net yield | | Without | |
|---|---|---|---|---|---|---|
| Example No. 6 | Feed | | Feed | | LCO | Δ |
| 650–800° F. | 18.2 | 13.0 | 23.5 | 17.6 | 14.1 | 4.4 |
| 800–1000° F. | 17.4 | 3.4 | 25.8 | 5.1 | 5.5 | (.4) |
| 1000° F.+ | 23.2 | 1.8 | 34.8 | 2.7 | 4.1 | (1.4) |
| 420° F.− Conversion, wt % | | 36.6 | | 42.7 | 52.1 | |
| Selectivities, (420° F.−) | | | | | | |
| $C_1 + C_2$ | | 8 | | 7 | 8 | |
| $C_3 + C_4$ | | 28 | | 30 | 45 | |
| $C_5$–420° F. | | 64 | | 63 | 47 | |
| $C_6$+ liquid properties | | | | | | |
| H, wt % | 11.53 | 11.75 | 12.00 | 12.12 | 11.30 | |
| S, wt % | 2.00 | 0.69 | 2.50 | 0.99 | 1.46 | |
| N, wt % | 0.16 | 0.12 | 0.12 | 0.15 | 0.12 | |
| Ni + V, PPM | 15.8 | 0.2 | 23.1 | 0.3 | 2.3 | |
| CCR, wt % | 3.67 | 0.61 | 5.48 | 0.92 | 3.7 | |
| $H_2$ consumption, SCF/BBL | | 820 | | 840 | 940 | |
| Total S removal, wt % | | 71 | | 67 | 62 | |
| Total N removal, wt % | | 65 | | 0 | 35 | |
| Total Ni + V removal, wt % | | 99 | | 99 | 93 | |
| Total CCR removal, wt % | | 85 | | 85 | 52 | |
| Material balance, wt % | | 97.8 | | — | 100.0 | |

EXAMPLES 7 & 8

Hydrocracking of North Slope Atmospheric Resid and Arab Light Vacuum Resid diluted with LCO.

The North Slope Atmosheric Resid was mixed with the Torrance FCC light cycle oil in a 2:1 (resid/LCO) ratio. The Arab Light Vacuum Resid was mixed with the Torrance FCC light cycle oil in a 1:1 ratio. A comparison of the net yields from LPHC of the above mixtures with the yields from LPHC of the resids alone is given in Table 5. The results clearly confirmed the advantage of solvent dilution, although the shift in LPG/distillate ratio was not as dramatic as in the case of the Arab Light Atmospheric Resid. It was also noted that all three resids when diluted with the FCC light cycle oil produced substantially the same slate of products as shown below:

| | Arab Light Atmospheric | North Slope Atmospheric | Arab Light Vacuum |
|---|---|---|---|
| Boiling range | 420° F.+ | 650° F.+ | 800° F.+ |
| 1000° F.+ in feed wt % | 34.8 | 49.0 | 60.7 |
| 420° F.− yield | 42.7 | 45.0 | 39.7 |

-continued

| | Arab Light Atmospheric | North Slope Atmospheric | Arab Light Vacuum |
|---|---|---|---|
| LPG selectivity | 30 | 29 | 28 |
| $C_5$+–420° F. selectivity | 63 | 61 | 61 |

Thus the FCC light cycle oil appears to eliminate the charge stock sensitivity described above. The shift in product distibution may be related to the specific nitrogen compounds present in the feed. It is possible that the specific and yet unidentified nitrogen compounds in the Torrance light cycle oil are most effective in reducing secondary cracking reactions.

Solvent dilution has additional benefits. It greatly eased the mechanical problems associated with handling resids. For example it eliminated the unit plugging problems frequently encountered without solvent dilution. The use of a refractory solvent could also have other commercial implication, e.g., the solvent could serve as a heat carrier which may be heated to above the reaction temperature and then mixed with the resid before entering the hydrocracker. Thus the hydrocracker may be operated at above the temperature to which resids may be heated.

TABLE 5

Comparisons of LPHC of Resids with LCO-Resid Mixtures

Pressure: 1100 psig
Temperature: 825° F./875° F. (HT/HC)
LHSV: 2/2 V/V/hr (HT/HC)
$H_2$/oil: 2,000 SCF/BBL

| | North Slope Atm. Resid | | | | Arab Lt. Vaccum Resid | | | |
|---|---|---|---|---|---|---|---|---|
| Example No. | Feed | Without Solvent 2 | With LCO 7* | Δ | Feed | Without Solvent 3 | With LCO 8* | Δ |
| Resid/LCO wt. ratio | | — | 2/1 | | | — | 1/1 | |
| Yield distribution, wt % | | | | | | | | |
| $C_1 + C_2$ | | 3.9 | 4.5 | 0.6 | | | 4.5 | 0 |
| $C_3 + C_4$ | | 16.6 | 13.3 | (3.3) | | 14.3 | 10.9 | (3.4) |
| $C_5$–420° F. | | 23.2 | 27.3 | 4.1 | | 22.4 | 24.3 | 1.9 |

TABLE 5-continued

Comparisons of LPHC of Resids with LCO-Resid Mixtures

Pressure: 1100 psig
Temperature: 825° F./875° F. (HT/HC)
LHSV: 2/2 V/V/hr (HT/HC)
$H_2$/oil: 2,000 SCF/BBL

| | North Slope Atm. Resid | | | | Arab Lt. Vaccum Resid | | | |
|---|---|---|---|---|---|---|---|---|
| Example No. | Feed | Without Solvent 2 | With LCO 7* | Δ | Feed | Without Solvent 3 | With LCO 8* | Δ |
| 420-650° F. | 1.2 | 20.6 | 23.0 | 3.0 | | 18.3 | 20.4 | 2.1 |
| 650-800° F. | 24.0 | 15.5 | 19.4 | 3.9 | 1.2 | 12.1 | 15.5 | 3.4 |
| 800-1000° F. | 25.8 | 11.2 | 6.7 | (4.5) | 38.1 | 11.4 | 10.6 | (0.8) |
| 1000° F.+ | 49.0 | 9.0 | 5.2 | (3.8) | 60.7 | 17.0 | 13.8 | (3.2) |
| Conversions, wt % | | | | | | | | |
| 420° F.− | | 43.7 | 45.0 | | | 41.2 | 39.7 | |
| 640° F.− | | 64.3 | 68.7 | | | 59.5 | 60.1 | |
| 800° F.− | | — | — | | | 71.6 | 75.6 | |
| Selectivities, (420° F.−) | | | | | | | | |
| $C_1 + C_2$ | | 9 | 10 | | | 11 | 11 | |
| $C_3 + C_4$ | | 38 | 29 | | | 35 | 28 | |
| $C_5$-420° F. | | 53 | 61 | | | 55 | 61 | |
| $C_6$+ liquid properties | | | | | | | | |
| H, wt % | 11.36 | 10.78 | 11.67 | | 10.60 | 10.22 | 10.63 | |
| S, wt % | 1.60 | 1.19 | 0.65 | | 4.13 | 2.80 | 2.68 | |
| N, wt % | 52.0 | 8.9 | 2.6 | 83.0 | 12.1 | 5.4 | | |
| Ni + V, ppm | 52.0 | 8.9 | 2.6 | | 83.0 | 12.1 | 5.4 | |
| CCR, wt % | 8.06 | 5.32 | 3.27 | | 17.47 | 12.45 | 8.32 | |
| $H_2$ consumption, SCF/BBL | | 840 | 1130 | | | 960 | 940 | |
| Total S removal, wt % | | 45 | 60 | | | 49 | 48 | |
| Total N removal, wt % | | 17 | 25 | | | 20 | 4 | |
| Total Ni + removal, wt % | | 87 | 96 | | | 89 | 95 | |
| Total CCR removal, wt % | | 34 | 69 | | | 46 | 62 | |
| Material Balance, wt % | | 101.7 | 100.7 | | | 94.0 | 98.2 | |

*net yield

EXAMPLES 9 & 10

Hydrocracking of resids diluted with tetralin

The Arab Light Atmospheric Resid was mixed with tetralin in a 2 to 1 ratio. The Arab Vacuum Resid was mixed with tetralin in a 1:1 ratio. The detailed material balances for LPHC of the above mixtures are given in Tables 6 and 7.

Chromatographic analysis of the $C_5$+ liquids showed a group of large peaks in the 400°-450° F. boiling range which clearly should be assigned to tetralin and its products. However, the total area in this boiling range was higher than could be expected from the tetralin data alone. It was apparent that the conversion of tetralin was inhibited significantly by the presence of the resid. Accordingly, in calculating the net yield for the resid, the products in the 400°-450° F. were treated as products from tetralin. The selectivity of other products from tetralin was assumed to be the same as that of tetralin alone. Details of the calculation are presented in Tables 6 and 7.

A comparison of the yield with and without tetralin is shown in Table 8. The data show that while tetralin gave a small increase in the efficiency of demetalation and CCR removal, it had little effect on yields. Thus the beneficial effects of FCC light cycle oil described earlier appears to be unique.

TABLE 6

LPHC of Arab Lt. Atm. Resid Diluted with Tetralin

Pressure: 1100 psig
Temperature: 825° F./875° F. (HT/HC)
LHSV: 2/2 V/V/hr (HT/HC)
$H_2$/oil: 2,000 SCF/BBL
Resid/Tetralin wt. ratio = 2/1

| | Example 9 | | | | | |
|---|---|---|---|---|---|---|
| | Raw Feed | Raw Data | Raw Data × 1.5 | Tetralin | Net Yield | Net Feed |
| Yield distribution, wt % | | | | | | |
| $C_1$ | | 1.4 | 2.1 | 0.1 | 2.0 | |
| $C_2$ | | 1.8 | 2.7 | 0.2 | 2.5 | |
| $C_3$ | | 7.7 | 11.6 | 1.0 | 10.6 | |
| $C_4$ | | 8.7 | 13.1 | 0.6 | 12.5 | |
| $C_5$-400° F. | | 21.0 | 31.5 | 7.9 | 23.6 | |
| 400-420° F. | 33.0 | 10.0 | 15.0 | 15.0 | 0 | |
| 420-450° F. | 10.6 | 15.9 | 23.8 | 23.8 | | 15.9 |
| 450-650° F. | | 17.4 | 26.1 | 1.3 | 24.7 | |
| 650-800° F. | 15.8 | 9.9 | 14.9 | 0.1 | 14.7 | 23.5 |
| 800-1000° F. | 17.4 | 4.1 | 6.2 | — | 6.2 | 25.8 |
| 1000° F.+ | 23.2 | 2.1 | 3.2 | — | 3.2 | 34.8 |
| | 100.0 | 100.0 | 150.0 | 50.0 | 100.0 | 100.0 |

TABLE 6-continued

LPHC of Arab Lt. Atm. Resid Diluted with Tetralin

Pressure: 1100 psig
Temperature: 825° F./875° F. (HT/HC)
LHSV: 2/2 V/V/hr (HT/HC)
$H_2$/oil: 2,000 SCF/BBL
Resid/Tetralin wt. ratio = 2/1

| | Example 9 | | | | | |
|---|---|---|---|---|---|---|
| | Raw Feed | Raw Data | Raw Data × 1.5 | Tetra-lin | Net Yield | Net Feed |
| 400° F.⁻ yield | | 40.6 | | | — | |
| 420° F.⁻ yield | | — | | | 51.3 | |
| $C_5$-400° F./400° F.⁻ | | 52 | | | — | |
| $C_5$-420° F./420° F.⁻ | | — | | | 47 | |

TABLE 7

LHPC of Arab Lt. Vacuum Resid Diluted with Tetralin

Pressure: 1100 psig
Temperature: 825° F./875° F. (HT/HC)
LHSV: 2/2 V/V/hr
$H_2$/oil: 2,000 SCF/BBL
Resid/Tetralin wt. ratio = 1/1

| | Example 10 | | | | | |
|---|---|---|---|---|---|---|
| | Raw Feed | Raw Data | Raw Data × 2 | Tetra-lin | Net Yield | Net Feed |
| Yield Distribution, wt % | | | | | | |
| $C_1$ | | 1.3 | 2.6 | 0.1 | 2.5 | |
| $C_2$ | | 1.5 | 3.0 | 0.4 | 2.6 | |
| $C_3$ | | 5.3 | 10.6 | 1.6 | 9.0 | |
| $C_4$ | | 5.7 | 11.4 | 1.0 | 10.4 | |
| $C_5$-400° F. | | 17.9 | 35.8 | 13.3 | 22.5 | |
| 400-420° F. | 50.0 | 18.0 | 36.0 | 36.0 | 0 | |
| 420-450° F. | — | 22.6 | 45.2 | 45.2 | | |
| 450-650° F. | — | 7.3 | 14.6 | 2.3 | 12.3 | |
| 650-800° F. | 0.6 | 5.0 | 10.0 | 0.1 | 9.9 | 1.2 |
| 800-1000° F. | 19.0 | 5.8 | 11.6 | — | 11.6 | 38.1 |
| 1000° F.⁺ | 30.4 | 9.6 | 19.2 | — | 19.2 | 60.7 |
| | 100.0 | 100.0 | 200.0 | 100.0 | 100.0 | 100.0 |
| 400° F.⁻ yield | | 31.7 | | | — | |
| 420° F.⁻ yield | | — | | | 46.6 | |
| $C_5$-400° F./400° F.⁻ | | 56 | | | — | |
| $C_5$-420° F./420° F.⁻ | | — | | | 48 | |

TABLE 8

Comparisons of LPHC of Resids and Tetralin-Resid Mixtures

Pressure: 1100 psig
Temperature: 825° F./875° F. (HT/HC)
LHSV: 2/2 V/V/hr (HT/HC)
$H_2$/oil: 2,000 SCF/BBL

| | Arab Lt. Atm. Resid | | | Arab Lt. Vacuum Resid | | |
|---|---|---|---|---|---|---|
| Example No. | Feed | 1 | 9* | Feed | 3 | 10* |
| Resid Tetralin wt. ratio | | — | 2/1 | | — | 1/1 |
| Yield Distribution, wt % | | | | | | |
| $C_1 + C_2$ | | 4.4 | 4.5 | | 4.5 | 5.1 |
| $C_3 + C_4$ | | 23.5 | 23.1 | | 14.3 | 19.3 |
| $C_5$-420° F. | | 25.3 | 23.7 | | 22.4 | 22.2 |
| 420-650° F. | 15.9 | 23.1 | 24.6 | | 18.3 | 12.3 |
| 650-800° F. | 23.5 | 14.1 | 14.7 | 1.2 | 12.1 | 10.0 |
| 800-1000° F. | 25.8 | 5.5 | 6.2 | 38.1 | 11.4 | 11.6 |
| 1000° F.⁺ | 34.8 | 4.1 | 3.2 | 60.7 | 17.0 | 19.2 |
| Conversions | | | | | | |
| 420° F.⁻ | | 52.1 | 51.3 | | 41.2 | 46.6 |
| 800° F.⁻ | | — | — | | 71.6 | 69.2 |
| Selectivities (420° F.⁻) | | | | | | |
| $C_1 + C_2$ | | 8 | 9 | | 11 | 11 |
| $C_3 + C_4$ | | 45 | 45 | | 35 | 41 |

TABLE 8-continued

Comparisons of LPHC of Resids and Tetralin-Resid Mixtures

Pressure: 1100 psig
Temperature: 825° F./875° F. (HT/HC)
LHSV: 2/2 V/V/hr (HT/HC)
$H_2$/oil: 2,000 SCF/BBL

| | Arab Lt. Atm. Resid | | | Arab Lt. Vacuum Resid | | |
|---|---|---|---|---|---|---|
| Example No. | Feed | 1 | 9* | Feed | 3 | 10* |
| $C_5$-420° F. | | 47 | 46 | | 55 | 48 |
| $C_6$ + liquid properties | | | | | | |
| H, wt % | 12.00 | 11.30 | na | 10.60 | 10.22 | na |
| S, wt % | 2.50 | 1.46 | 1.53 | 4.13 | 2.80 | 3.38 |
| N, wt % | 0.12 | 0.12 | 0.15 | 0.32 | 0.34 | 0.35 |
| Ni + V, PPM | 23.1 | 2.3 | 0.8 | 83.0 | 12.1 | 12.4 |
| CCR, wt % | 5.48 | 3.17 | 1.95 | 17.47 | 12.45 | 12.96 |
| $H_2$ consumption | | 940 | na | | 960 | na |
| Total S removal, wt % | | 62 | 60 | | 49 | 43 |
| Total N removal, wt % | | 35 | 18 | | 20 | 25 |
| Total Ni + V removal, wt % | | 93 | 98 | | 89 | 90 |
| Total CCR removal, wt % | | 52 | 77 | | 46 | 49 |

*net yield

Table 9 contains the available data on products from LPHC of resids without solvent. Table 10 contains the raw data from LPHC resids mixed with FCC light cycle oil. The $C_5$-420 naphthas produced in all cases are rich in n-paraffins. Consequently, they have relatively low clear octane ratings. However, these naphthas contain 45–50 percent naphthenes and aromatics and should be readily reformable to higher octanes. Solvent dilution has a pronounced effect on the quality of the distillate. Both 420°–650° F. and 650°–680° F. products are richer in hydrogen and lower in sulfur. The 420° F.+ products are also better cracking stocks because of their lower Conradson carbon concentration, and lower metal contaminants.

TABLE 9

| | Product Qualities of LPHC of Resid Without Solvent | | | | | |
|---|---|---|---|---|---|---|
| | Arab. Lt. Atm. Resid | | North Slope Atm. Resid | | Arab Lt. Vacuum Resid | |
| Example No. | Feed | 1 | Feed | 2 | Feed | 3 |
| $C_6$–420° F. yield, wt % | — | 18.0 | — | 17.0 | — | 16.9 |
| H, wt. % | — | 13.42 | — | 13.01 | — | 14.05 |
| mol. wt. | — | 111.1 | — | 114.9 | — | 113.7 |
| n-P, wt. % | — | 17.0 | — | 20.0 | — | 44.8 |
| i-P, wt. % | — | 28.0 | — | 19.4 | — | |
| O, wt. % | — | 9.6 | — | 21.7 | — | 9.4 |
| N, wt. % | — | 21.0 | — | 23.4 | — | 26.9 |
| A, wt. % | — | 24.4 | — | 15.5 | — | 18.8 |
| RON + O | — | 72.8 | — | 69.5 | — | 60.0 |
| 420–650° F. yield, wt % | 15.9 | 23.1 | 1.2 | 20.6 | — | 18.3 |
| H, wt. % | 13.20 | 11.55 | — | 11.75 | | 11.91 |
| S, wt. % | 0.97 | 1.29 | — | 0.83 | | 1.82 |
| N, wt. % | 0.01 | 0.03 | — | 0.12 | | 0.07 |
| 650–800° F. yield, wt % | 23.5 | 14.1 | 24.0 | 15.5 | 1.2 | 12.1 |
| H, wt. % | 12.46 | 10.22 | 12.01 | 10.65 | — | 9.69 |
| S, wt. % | 2.11 | 2.53 | 1.09 | 1.20 | — | 2.84 |
| N, wt. % | 0.04 | 0.13 | 0.10 | 0.38 | — | 0.22 |
| 800° F.+ yield, wt % | 60.6 | 9.6 | 74.8 | 20.2 | 98.8 | 28.4 |
| 420° F.+ yield, wt % | 100.0 | 46.8 | 100 | 56.3 | 100.0 | 58.8 |
| CCR in 420° F.+, wt % | 5.48 | 4.39 | 8.06 | 6.92 | 17.47 | 16.02 |
| Metal in 420° F.+, PPM | 23.0 | 3.2 | 52.0 | 11.6 | 83.0 | 15.6 |

TABLE 10

| | Product Qualities of LPHC of LCO-Resid Mixtures | | | | | |
|---|---|---|---|---|---|---|
| | Arab Lt. Atm. Resid | | North Slope Atm. Resid | | Arab Lt. Vacuum Resid | |
| Run No. 77- | Feed | 6 | Feed | 7 | Feed | 8 |
| Resid/LCO Wt. Ratio | | 2/1 | | 2/1 | | 1/1 |
| $C_6$–420° F. yield, wt % | 1.6 | 19.1 | 1.6 | 19.5 | 2.4 | 17.7 |
| H, wt % | — | 13.38 | — | 13.48 | — | 13.33 |
| mol. wt. | — | 118.8 | — | 116.8 | — | 114.0 |
| n-P, wt % | — | 21.7 | — | 20.6 | — | 34.7 |
| i-P, wt % | — | 23.3 | — | 20.7 | — | |
| O, wt % | — | 10.9 | — | 14.0 | — | 15.6 |
| N, wt % | — | 18.9 | — | 22.6 | — | 20.7 |
| A, wt % | — | 25.2 | — | 22.1 | — | 29.0 |
| RON + O | — | 70.1 | — | 70.2 | — | 71.9 |
| 420–650° F. yield, wt % | 40.6 | 45.2 | 30.1 | 39.6 | 44.0 | 46.1 |
| H, wt % | 11.50 | 11.75 | 10.64 | 11.55 | 10.64 | 10.84 |
| S, wt % | 0.99 | 0.39 | 1.01 | 0.31 | 1.01 | 0.63 |
| N, wt % | 0.16 | 0.09 | 0.24 | 0.16 | 0.24 | 0.14 |
| 650–800° F. yield, wt % | 18.2 | 13.0 | 18.4 | 14.2 | 4.2 | 9.6 |
| H, wt % | 12.46 | 10.75 | 12.01 | 10.90 | — | 9.97 |
| S, wt % | 2.11 | 1.52 | 1.09 | 0.74 | — | 2.06 |
| N, wt % | 0.04 | 0.22 | 0.10 | 0.30 | — | 0.35 |
| 800° F.+ | | | | | | |

TABLE 10-continued

| | Product Qualities of LPHC of LCO-Resid Mixtures | | | | | |
|---|---|---|---|---|---|---|
| | Arab Lt. Atm. Resid | | North Slope Atm. Resid | | Arab Lt. Vacuum Resid | |
| Run No. 77- | Feed | 6 | Feed | 7 | Feed | 8 |
| yield, wt % | 40.6 | 5.2 | 49.9 | 8.0 | 49.4 | 12.2 |
| 420° F.+ yield, wt % | 98.4 | 63.4 | 98.4 | 61.8 | 97.6 | 67.9 |
| CCR in 420° F.+ wt % | 3.73 | 0.79 | 5.49 | 2.86 | 8.95 | 5.24 |
| Metal in 420° F., PPM | 15.7 | 0.3 | 35.4 | 2.3 | 42.6 | 4.6 |

The beneficial effects of FCC light cycle oil on the vacuum resid suggests a process scheme in which the riser cracking of gas oil is integrated with the cascade low pressure hydrocracking of vacuum resid as alternatives to either the delayed coking or hydrotreating of the residual stock. See FIG. 1. Preliminary estimate of such a process designed to utilize the current facilities at an existing refinery indicated a potential increase of 7.6 wt. % $C_4$+ gasoline per barrel of reduced crude over the current operation.

Co-feeding light cycle oil improves significantly the efficiency of demetalation and Conradson Carbon removal—two of the critical variables affecting the commercial viability of the resid hydrotreating/FCC process. Integration of the FCC process with the hydrotreating process by co-feeding the light cycle oil with the resid in the hydrotreater can be expected to improve the efficiency of the hydrotreating process. The results also suggest that with solvent dilution the hydrotreating process may be carried out at higher space velocities and lower pressures, reducing the cost of the hydrotreating process.

As previously pointed out, the invention comtemplates use of light distillate fractions from various sources which have distillation and chemical characteristics like those of the light catalytic cycle oils which have been exemplified. These are high nitrogen aromatic fractions and may be from various sources such as the exemplified light cycle oils from catalytic cracking as well as coker gas oils, shale oil fractions, high nitrogen virgin gas oils from aromatic crudes (e.g. California gas oils) and the like.

The boiling range of suitable aromatic nitrogeneous diluents will be above the gasoline range, with initial boiling points in the neighborhood of 400° F. or above. The preferred distillates will have a boiling range within the limits of about 450° F. to 700° F. Total aromatics will generally be in the range of 40 to 70 weight percent, including 15 to 40 weight percent of dicyclic aromatics, preferably 20 to 30 weight percent of such dicyclics.

The nitrogen content of the light distillate may be as high as 1 weight percent but more usually and preferably will be in the range of 0.1 to 0.5 weight percent.

What is claimed is:

1. In a process for upgrading a residual petroleum fraction by passing the same in admixture with hydrogen as charge successively through a catalytic hydrotreating zone containing a hydrotreating catalyst and a hydrocracking zone containing a hydrocracking catalyst and separating an upgraded product from the effluent of said hydrocracking zone; the improvement which comprises adding to said residual petroleum fraction a nitrogen containing light aromatic distillate oil boiling in the range of about 400° F. to about 700° F.

2. A process according to claim 1 wherein said hydrotreating and said hydrocracking are conducted at a pressure below about 1500 psig.

3. A process according to claim 2 wherein said pressure is 200 to 1500 psig.

4. A process according to claim 2 wherein said pressure is about 1000 psig.

5. A process according to claim 1 wherein said hydrocracking catalyst comprises a crystalline zeolite having a silica/alumina ratio above 12 and a constraint index of 1 to 12.

6. A process according to claim 5 wherein said hydrocracking catalyst comprises zeolite ZSM-5.

7. A process according to claim 1 wherein said light distillate oil contains 0.1 to 1.0 weight percent nitrogen.

8. A process according to claim 1 wherein the ratio of light distillate oil to resid is in the range of about 0.1 to about 2.

9. A process according to claim 7 wherein said light distillate oil contains 0.1 to 0.5 weight percent nitrogen.

10. A process according to claim 1 wherein said light distillate oil boils in the range of about 450° F. to about 700° F.

11. A process according to claim 1 wherein said light distillate oil contains 40 to 70 weight percent aromatic compounds.

12. A process according to claim 11 wherein said light distillate oil contains 15 to 40 weight percent dicyclic aromatic compounds.

13. A process according to claim 12 wherein said light distillate oil contains 20 to 30 weight percent dicyclic aromatic compounds.

14. A process according to claim 1 wherein said light distillate oil boils in the range of about 450° F. to about 700° F. and contains 0.1 to 0.5 weight percent nitrogen, 40 to 70 weight percent total aromatic compounds and 20 to 30 weight percent dicyclic aromatic compounds.

15. A process according to claim 1 wherein said light distillate oil is a light cycle oil from catalytic cracking.

* * * * *